US005206565A

United States Patent [19]

Lüssi et al.

[11] Patent Number: 5,206,565

[45] Date of Patent: Apr. 27, 1993

[54] HIGH-POWER LOW-VOLTAGE TETRODE HAVING A FULL WALLED MATRIX CATHODE AND A CONTROL GRID SPACING OF LESS THAN 1 MM

[75] Inventors: Fritz Lüssi, Brugg; Hans-Gunter Mathews, Oberehrendingen, both of Switzerland; Werner Rohrbach, Waldshut-Tiengen, Fed. Rep. of Germany

[73] Assignee: Asea Brown Boveri Ltd., Baden, Switzerland

[21] Appl. No.: 805,613

[22] Filed: Dec. 12, 1991

[30] Foreign Application Priority Data

Jan. 21, 1991 [EP] European Pat. Off. ..... 91100661.7

[51] Int. Cl.[5] ..... H01J 11/04; H01J 1/46

[52] U.S. Cl. ..... 315/349; 313/293; 313/296; 313/348; 313/248; 328/252

[58] Field of Search ..... 313/247, 248, 308, 293, 313/350, 294, 296, 297, 346 R, 262, 265, 285, 289; 315/349, 39, 40; 328/252

[56] References Cited

U.S. PATENT DOCUMENTS

| | | | |
|---|---|---|---|
| 2,951,172 | 8/1960 | Griffiths, Jr. et al. | 313/247 |
| 4,076,992 | 2/1978 | Mark | 313/296 |
| 4,295,077 | 10/1981 | Carter | 313/293 |
| 4,302,701 | 11/1981 | Beling | 313/293 |
| 4,387,320 | 6/1983 | Hoet | 313/293 |
| 4,779,022 | 10/1988 | Badenhoop et al. | 313/296 |

FOREIGN PATENT DOCUMENTS

| | | | |
|---|---|---|---|
| 0282040 | 9/1988 | European Pat. Off. . | |
| 902051 | 1/1954 | Fed. Rep. of Germany . | |
| 3017429 | 11/1981 | Fed. Rep. of Germany . | |
| 2033144 | 5/1980 | United Kingdom | 313/296 |

OTHER PUBLICATIONS

ABB Review, Nr. 10, 1990, Zurich, CH, "New Tetrodes for Industry", pp. 11-16.

Brown Boveri Mitteilungen, Nr. 5, 1975, Baden, CH, Bachmann, Robert: "CQS 400-1, Eine Neue Siedegekuhite Hochstleistungs-Tetrode", pp. 194-197.

Brown Boveri Review, Nr. 1, 1979, Baden, CH, pp. 40-42, E. Egerszegi & D. Kuse: "The CQ Range: High--Power Tetrodes for Broadcasting Transmitters up to 1000 kW".

IEEE Transactions on Broadcasting, Bd 34, Nr. 2, Jun. 1988, New York, U.S.A., pp. 141-146, J. T. Mark et al.: "New High Efficiency 500 kW Tetrodes for Short Wave Broadcast".

BBC Short Data Catalog Electron Tubes, Document No. CH-E, 3.30475.8 D/F/E/S/, 1982-1983.

Brown Boveri Tech 74, 1987 (6), pp. 296-302, "Neueste Entwicklungen Auf Dem Gebiet Der Hochleistungssender".

Brown Boveri Review 71, 1985(5) pp. 197-201, Kurt Holm, et al.: "Entwicklungskonzepte . . . ".

(List continued on next page.)

*Primary Examiner*—Robert J. Pascal
*Assistant Examiner*—Michael B. Shingleton
*Attorney, Agent, or Firm*—Oblon, Spivak, McClelland, Maier & Neustadt

[57] ABSTRACT

In a controllable high-power electron tube in the form of a tetrode, the anode direct voltage is reduced to less than 10 kV with an anode efficiency of greater than 80%. The tube includes coaxially arranged electrodes including a cylindrical indirectly heated full walled matrix cathode containing BaO, a cylindrical control grid, a cylindrical screen grid and an anode, where the spacing between the control grid and the cathode and the spacing between the control grid and the screen grid is less than 1 mm. Such a tube can be used for achieving AM broadcast transmitters which are distinguished by a compact construction, the overall efficiency remaining largely unchanged.

5 Claims, 2 Drawing Sheets

OTHER PUBLICATIONS

Meinke/Gundlach, Taschenbuch der Hochfrequenztechnik (Pocket Book of Radiofrequency Engineering) 4th Edition, Springer-Verlag 1986, p. 9.

Brown Boveri Review 69, 1982 (6), pp. 212-217, Fritz Langmeier & Andreas Furrer: "Der Neue 250-kW-Kurzwellensender".

Brown Boveri Review 67, 1980 (3), pp. 215-219, Jurg Wyss: "Der Neue Brown Boveri 100-kW-Kurzwellensender: Klein, Modern, Wirtschaftlich".

Brown Boveri Review, 66, 1979 (1), pp. 40-42, Lajos Egerszegi and Dieter Kuse, "CQ-Reihe: Hochleistungstetroden fur Rundfunksender bis 1000 kW".

Brown Boveri Review 67, 1980 (3), pp. 215-219, Jirg Wuss, "Der Neue Brown Boveri 100-kW-Kurzwellensender: klein, Modern, Wirtschaftlich".

Meinke/Gundlach, Taschenbuch der Hochfrequenztechnik, (Pocket Book of Radiofrequency Engineering), 3rd Edition, Springer-Verlag 1968, pp. 1035-1037.

HIGH-POWER LOW-VOLTAGE TETRODE HAVING A FULL WALLED MATRIX CATHODE AND A CONTROL GRID SPACING OF LESS THAN 1 MM

BACKGROUND OF THE INVENTION

1. Field of the Invention

The present invention relates to the field of power electronics. In particular, it relates to a controllable high-power electron tube in the form of a tetrode having an output power $P_0$ of at least 100 kW, which high-power electron tube comprises a cathode, a control grid, a screen grid and an anode in coaxial cylindrical arrangement.

Such a high-power electron tube is known, for example, by the type designation CQK 50-2 from the printed document Brown Boveri Review 66, 1979 (1), pages 40–42. The typical application of this tube in a broadcast transmitter is described in the printed document Brown Boveri Review 67, 1980 (3), pages 215–219.

2. Discussion of Background

High-power electron tubes of the type initially mentioned are usually employed as output stage tubes in broadcast transmitters with amplitude modulation (AM), particularly in the short-wave band (about 3.9–26.1 MHz). Such a broadcast transmitter comprises an AF and an RF section.

The AF section provides for the processing and power amplification of the AF signal to be transmitted, which is then applied to the anode of the output stage tube in the case of the usual anode modulation. In the RF section, the carrier-frequency oscillator with the subsequent driver stage provides a power-amplified carrier signal which passes to the control grid of the output stage tube and, together with the anode voltage, which oscillates at the rate of the AF signal, emits the desired AM signal to a load, the antenna.

Since such broadcast transmitters usually operate within a power range of more than 50 kW up to a few 100 kW output power, the efficiency, that is to say the ratio between power used and usable power, plays a central role in the development and design of such a transmitter. The output stage tube takes a significant share of the total efficiency of the transmitter which can be greater than 70%.

Its efficiency, the so-called anode efficiency, is proportional to, among other things, the expression $1-(u_s/u_{a0}$, where $u_s$ (also called $U_{ar}$) is the residual voltage which cannot be modulated and $u_{ao}$ (also called $U_a$) is the anode direct voltage. With the residual voltage remaining constant, the anode efficiency therefore rises with increasing anode direct voltage (Brown Boveri Review 71, 1984(5), page 199).

In all cases, a good anode efficiency therefore requires a high anode direct voltage $u_{ao}$ so that the unmodulatable residual $u_s$ remains relatively small by comparison (see also: Meinke/Gundlach, Taschenbuch der Hochfrequenztechnik, (Pocket Book of Radiofrequency Engineering), 3rd edition, Springer-Verlag 1968, pages 1035–1037). The usual operating voltages in large transmitters with high-power tetrodes in the RF output stage are therefore between 10 and 14 kV (see also: Meinke/Gundlach, Taschenbuch der Hochfrequenztechnik (Pocket Book of Radiofrequency Engineering) 4th edition, Springer-Verlag 1986, page P9).

The following two shortwave transmitters can be used as examples for these values achieved in the prior art:

(1) The 250-kW shortwave transmitter described in the printed document Brown Boveri Review 69, 1982 (6), pages 212–217, the RF output stage of which is equipped with a high-power tetrode of the BBC CQK 350-1 type. This tetrode operates in class C mode with anode modulation, with an anode direct voltage of 14 kV, a screen grid direct voltage of 1300V and a control grid direct voltage of −900V and has an efficiency of 85.2%.

(2) The 100-kW shortwave transmitter described in the printed document Brown Boveri Review 67, 1980 (3), pages 215–219, described initially, the RF output stage of which is equipped with a high-power tetrode of the BBC CQK 50-2 type. This tetrode operates in class C mode with anode modulation, with an anode direct voltage of 11 kV, a screen grid direct voltage of 800V and a control grid direct voltage of −600V (see also BBC short data catalog electron tubes, printed document No. CH-E 3.30475.8 D/F/E/S of 1982/83).

The comparatively high anode voltages, in connection with the anode modulation, require correspondingly designed modulation amplifiers which have to supply output voltages from 0 to 28 kV with an anode direct voltage of 14 kV.

If, for example, a pulse step modulator PSM, that is to say a digital switched-mode amplifier, is used as modulation amplifier, 32 switching stages, for example, are needed within this PSM, the output voltages of which add up to the desired anode voltage (Brown Boveri Tech. 74, 1987(6) , pages 296–302). Since each individual one of these 32 high-power switching stages requires the corresponding space, separate cabinets must be provided for the PSM in the transmitter.

But the high anode direct voltage and the voltage strength required for it also leads to increased space requirement for other components of the transmitter circuit, with the result that the transmitter overall is inevitably very costly to produce.

SUMMARY OF THE INVENTION

It is therefore the object of the present invention to create a high-power electron tube by means of which a broadcast transmitter can be built up which is distinguished by reduced constructional expenditure and less space requirement, the efficiency remaining the same.

In a high-power electron tube of the type initially mentioned, this object is achieved by the fact that (a) the high-power electron tube is designed for an anode direct voltage of less than 10 kV; and (b) exhibits an anode efficiency of greater than 80% at this anode direct voltage.

The core of the invention consists in designing the tube as a low-voltage tetrode which, with a clearly reduced anode direct voltage, has a comparable efficiency to conventional high-power tetrodes.

A first preferred embodiment of the high-power electron tube according to the invention is distinguished by the fact that (a) the cathode is designed as indirectly heated matrix cathode containing BaO;

(b) the matrix cathode is constructed as a full-walled cylinder; and (c) the control grid and the screen grid have a distance of less than 1 mm from one another and from the matrix cathode.

This embodiment, for reduction in anode direct voltage with the efficiency remaining the same is achieved by a considerable reduction in electrode spacings which, among other things, is made possible by the fact that the cathode temperature is severely reduced by a special construction of the cathode with high electron emission.

Since the grid direct voltages are also reduced with the anode direct voltage (the control grid direct voltage determines the residual anode voltage mentioned above), the efficiency of the tube and thus of the transmitter can be largely kept.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
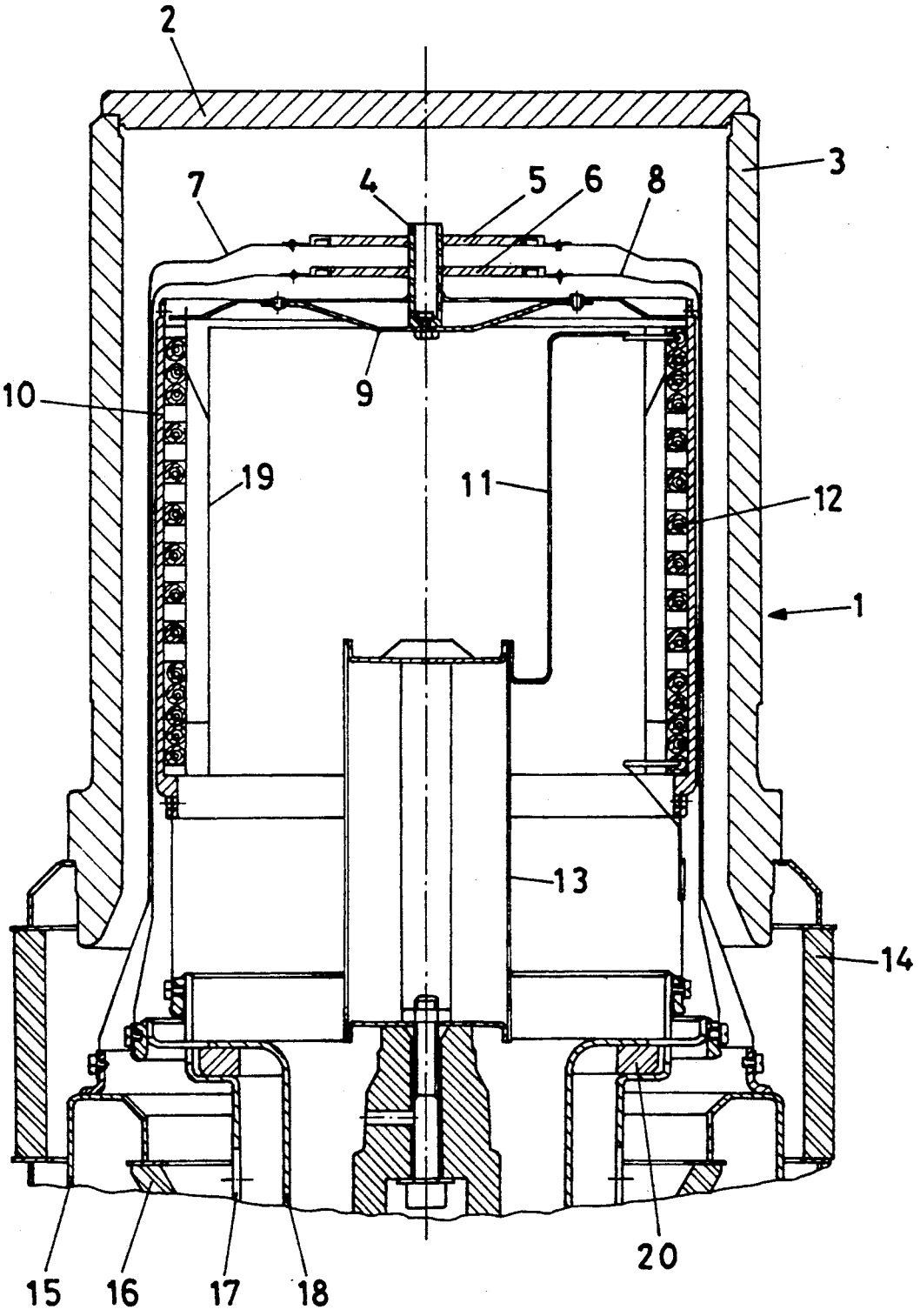
FIG. 1 shows in a cross section the structure of a low-voltage tetrode according to a preferred exemplary embodiment of the invention.

Referring now to the drawings, wherein like reference numerals designate identical or corresponding parts throughout the several views, a preferred embodiment of a low-voltage tetrode according to the invention, which, with an anode efficiency of greater 80% (especially >83%) is operated with an anode direct voltage of less than 10 kV (especially about 5 kV), and which is provided as output stage tube for a 100-kW shortwave transmitter, is reproduced in section in FIG. 1. For reasons of clarity, a detailed representation of the lower tube base and the outer anode cooling (which are known per se) have been omitted.

Figure 2:
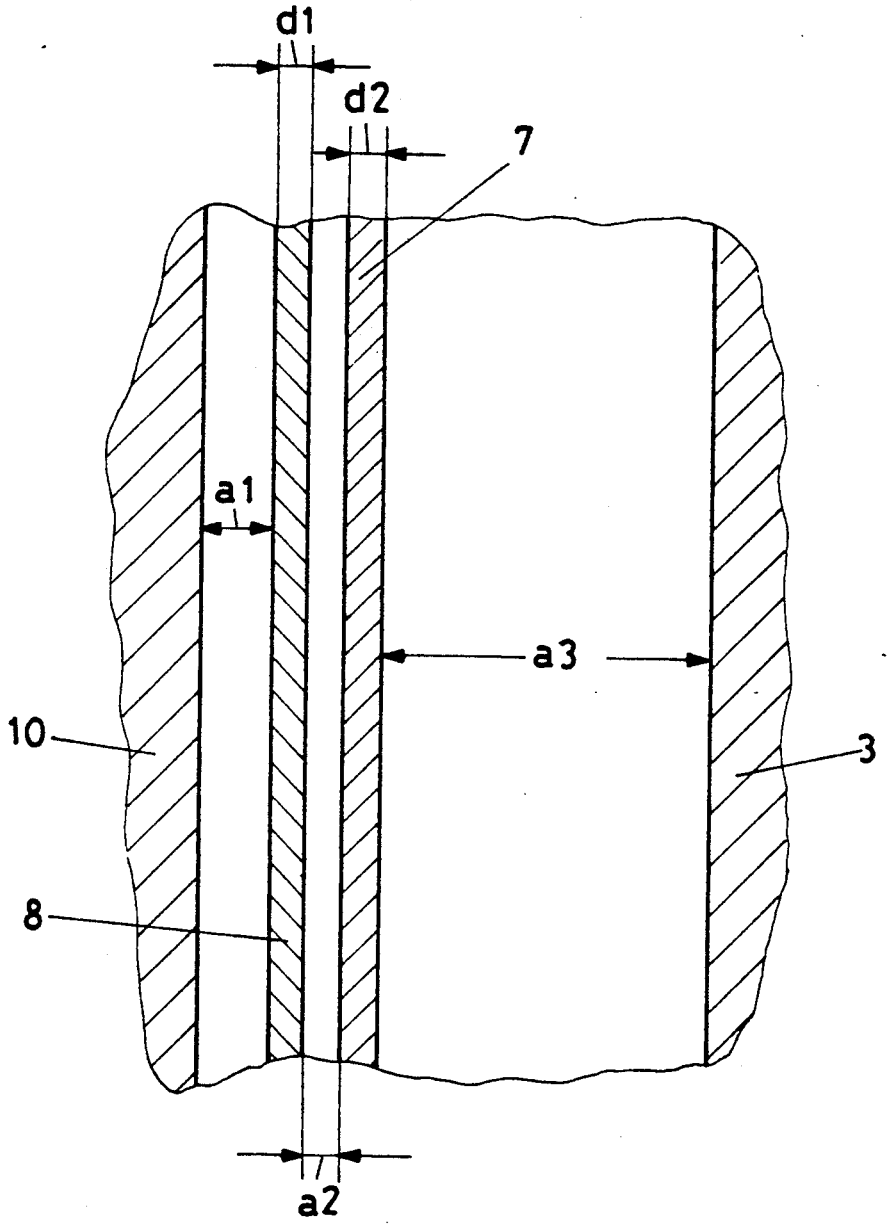
FIG. 2 shows in an enlarged cutout the geometry of the electrode arrangement in a tube according to FIG. 1.

The electrode arrangement of the tube is shown in a cut out and enlarged in FIG. 2.

The tube shown contains as essential elements, in coaxial arrangement from the inside to the outside, a cylindrical full-walled matrix cathode 10, a pot-shaped control grid 8, a pot-shaped screen grid 7 and an anode cylinder 3 which is closed at the top by an anode cover 2.

The anode cylinder 3 is insulated by a ceramic ring 14 towards the tube base. The screen grid 7 changes into a screen grid connection 15 towards the bottom, the control grid 8 changes into a control grid connection 18 and the matrix cathode 10 changes into a cathode connection 17.

In a metal matrix, the matrix cathode 10 contains BaO, which forms a Ba layer on the surface which, compared with conventional tungsten thorium cathodes (operating temperature of about 1900° K.) emits at very much lower temperatures (about 1000°-1100° K.). The matrix cathode 10 is indirectly heated by a heating filament 12 arranged on its inside and shielded towards the inside by a radiation shield 19. The heating current needed for this is supplied to the heating filament 12 via a central inner metal cylinder 13 and an adjoining feed line 11 and via the cathode connection 17.

As can be seen from FIG. 1, the number of turns per unit length of the heating filament 12 preferably varies in the axial direction: the filament is wound tighter in each case at the ends of the cathode cylinder than in the center. Due to this measure, a uniform temperature distribution can be set, where necessary, in accordance with the tube design, in order to ensure homogeneous emission over the entire cathode surface.

The comparatively low operating temperature of the matrix cathode 10 reduces, apart from the required heating power, mainly the thermo-mechanical stresses in the electrode system caused by the temperature differences so that control grid 8 and screen grid 7 can be arranged very close to the cathode.

Whereas the distance between the cathode and the control grid and the distance between the control grid and the screen grid are between 1 and 2 mm in a conventional high-power transmitting tetrode with tungsten thorium cathode and an anode direct voltage of about 14 kV, these distances (a1 and a2 in FIG. 2) are less than 1 mm in the exemplary embodiment described here and are preferably about 0.55 mm and 0.45 mm, respectively, for a low-voltage tetrode with an anode direct voltage of about 5 kV.

The small electrode spacings with tolerances within a range of 1/100 mm require careful mounting of the individual electrodes: control grid 8 and screen grid 7 are mounted at their top end via ceramic disks 5, 6 and a central ceramic sleeve 4 on a holding plate 9 coming from the matrix cathode 10. In the tube base, the control grid connection 18 is conducted through the cathode connection 17 into the interior where it is supported at the cathode connection 17, preferably by means of a first ceramic support ring 20.

Due to these measures, the critical electrode spacings can be maintained particularly effectively. Further support rings, one of which (16) is shown partially in FIG. 1, are arranged between the other connections in a manner known per se.

Control grid 8 and screen grid 7 are preferably fabricated from pyrolytic graphite in the form of perforated cylinders and in each case produced with a thickness (d1 and d2, respectively, in FIG. 2) of about 0.3 mm. The distance between the screen grid 7 and the anode cylinder 3 (a3 in FIG. 2) is then about 6.4 mm.

To provide a better overview, the electrical operating values of a low-voltage tetrode (LVT) in the preferred embodiment for a 100 kW shortwave transmitter will again be compared in the following table with the operating values of a conventional tetrode of the same power (the BBC CQK 50-2 initially mentioned):

| Operating Parameter | LVT | CQK 50-2 |
|---|---|---|
| Anode direct voltage | 5 kV | 11 kV |
| Screen grid voltage | ≦500 V | 800 V |
| Control grid voltage | −150 V | −600 V |
| Control grid direct current | 1 A | 0.4 A |
| Anode direct current | ≦26 A | 10 A |
| Anode efficiency | >83% | 85% |
| Heating power | <2 kW | 4.2 kW |

The table easily shows that, compared with the conventional tetrode, the low-voltage tetrode requires a very much lower anode direct voltage, a considerably lower drive power and a highly reduced heating power for its operation, the efficiency being almost unchanged.

These characteristics have direct advantageous effects on the constructional design of a transmitter equipped with this tube:

because of the low anode direct voltage, the modulation amplifier, if it is designed as digital PSM amplifier, can now be equipped with only 14 or fewer switching stages instead of 32 as previously. This reduces the space requirement to such an extent that the PSM amplifier can be accommodated directly in the cabinet for the RF section.

Because of the low drive power, the previously used driver tube can be replaced by a lower-power transistorized driver amplifier which is an advantage for the overall efficiency and further reduces the space requirement.

Because of the reduced heating power and the low cathode temperature, the efficiency is improved and the service life of the output stage tube is considerably prolonged.

Overall, the high-power electron tube according to the invention thus makes it possible to construct a transmitter which is distinguished by a compact construction and very high reliability, the overall efficiency remaining at the same high level.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Controllable high-power electron tube in the form of a tetrode for an output power of at least 100 kW, comprising;

a coaxial electrode arrangement comprising a cylindrical cathode with a first radius, a cylindrical control grid with a second radius which is larger than said first radius, a cylindrical screen grid with third radius which is larger than said second radius, and an anode surrounding said screen grid, wherein the difference between said second radius and said first radius and the difference between said third radius and said second radius are each smaller than 1 mm;

said cathode comprising an indirectly heated matrix cathode containing BaO; and said cylinder of said cathode being full-walled.

2. High-power electron tube as claimed in claim 1, wherein (a) the anode direct voltage is about 5 kV;

(b) the distance (al) from the control grid (8) to the matrix cathode (20) is about 0.55 mm and the distance (a2) from the screen grid (7) to the control grid (8) is about 0.45 mm; and (c) the cathode and control grid (8) exhibit at the base of the high-power electron tube (1) a cylindrical cathode connection (17) and control grid connection (18), the control grid connection (18) extending coaxially in the interior of the cathode connection (17) and being supported against the latter.

3. High-power electron tube as claimed in claim 2, wherein the control grid (8) and the screen grid (7) are constructed as perforated cylinders of pyrolytic graphite.

4. High-power electron tube as claimed in claim 2, wherein a ceramic support ring (20) is used for supporting the control grid connection (18) against the cathode connection (17).

5. High-power electron tube as claimed in claim 1, wherein (a) a heating filament (12) is attached to the inside of the cathode cylinder for heating the matrix cathode (10); and (b) the heating filament (12) exhibits a varying number of turns per unit length in the axial direction for achieving a uniform temperature distribution over the emission area of the matrix cathode (10).

* * * * *